US010946409B2

(12) United States Patent
Buffa et al.

(10) Patent No.: US 10,946,409 B2
(45) Date of Patent: Mar. 16, 2021

(54) DEVICE AND METHOD FOR APPLYING ADHESIVE TO CORES BY A DISPENSING MEANS WHILE THE CORES MOVE ALONG A FEED DIRECTION, THE CORES USED TO PRODUCE A LOG

(71) Applicant: GAMBINI S.p.A., Milan (IT)

(72) Inventors: Giovanni Buffa, Ponte Buggianese (IT); Fabio Picchi, Lammari (IT)

(73) Assignee: GAMBINI S.p.A., Milan (IT)

( * ) Notice: Subject to any disclaimer, the term of this patent is extended or adjusted under 35 U.S.C. 154(b) by 117 days.

(21) Appl. No.: 16/033,622

(22) Filed: Jul. 12, 2018

(65) Prior Publication Data

US 2019/0015863 A1 Jan. 17, 2019

(30) Foreign Application Priority Data

Jul. 17, 2017 (IT) ..... 102017000080654

(51) Int. Cl.
*B65H 19/28* (2006.01)
*B05B 13/04* (2006.01)
(Continued)

(52) U.S. Cl.
CPC ..... *B05C 5/0241* (2013.01); *B05B 9/04* (2013.01); *B05B 12/124* (2013.01); *B05B 13/0221* (2013.01); *B05B 13/041* (2013.01); *B05B 13/0405* (2013.01); *B05B 13/0447* (2013.01); *B05B 13/0473* (2013.01); *B05C 5/0208* (2013.01); *B05C 5/0216* (2013.01); *B05C 5/0291* (2013.01); *B05C 11/1018* (2013.01); *B05C 11/1034* (2013.01); *B05C 11/11* (2013.01); *B05C 13/02* (2013.01); *B05D 1/40* (2013.01); *B05D 1/42* (2013.01); *B31B 50/624* (2017.08); *B65H 19/283* (2013.01);
(Continued)

(58) Field of Classification Search
CPC ... B05C 11/1034; B05D 1/42; B05B 13/0447; B05B 13/041
See application file for complete search history.

(56) References Cited

U.S. PATENT DOCUMENTS 5,242,525 A * 9/1993 Biagiotti ..... B65H 19/29 156/357
5,735,481 A 4/1998 Loosen
(Continued)

FOREIGN PATENT DOCUMENTS

DE 102015114391 A1 3/2017

OTHER PUBLICATIONS

Italian Search Report dated Mar. 7, 2018 from Italian Application No. 201700080654.

*Primary Examiner* — Karl Kurple
(74) *Attorney, Agent, or Firm* — Innovation Capital Law Group, LLP; Vic Lin

(57) ABSTRACT

A device (1) applies adhesive to cores which are used to produce a log includes a moving means (3) configured to cause at least one core (5) to advance along a feed direction (A) and a dispensing means (7) configured for dispensing an amount of adhesive (9) on the core (5). The dispensing means (7) are moveable along an application direction (B) substantially orthogonal to the feed direction (A) and are configured to selectively dispense an amount of adhesive (9) along portions (11) of the core (5) during movement along the application direction (B).

10 Claims, 4 Drawing Sheets

(51) Int. Cl.

| | |
|---|---|
| ***B05C 13/02*** | (2006.01) |
| ***B05D 1/42*** | (2006.01) |
| ***B05C 5/02*** | (2006.01) |
| ***B05C 11/10*** | (2006.01) |
| ***B05B 9/04*** | (2006.01) |
| ***B05B 12/12*** | (2006.01) |
| ***B05D 1/40*** | (2006.01) |
| ***B05B 13/02*** | (2006.01) |
| ***B05C 11/11*** | (2006.01) |
| ***B31B 50/62*** | (2017.01) |

(52) U.S. Cl.
CPC ..... *B05D 2203/22* (2013.01); *B65H 2301/41424* (2013.01); *B65H 2406/211* (2013.01); *Y10T 156/1798* (2015.01)

(56) References Cited

U.S. PATENT DOCUMENTS

| | | | | |
|---|---|---|---|---|
| 6,253,818 | B1 | 7/2001 | Preinknoll | |
| 6,372,064 | B1 * | 4/2002 | Butterworth | B65H 19/29 156/187 |
| 6,858,250 | B2 * | 2/2005 | Fort | B65B 51/023 427/207.1 |
| 7,100,657 | B2 | 9/2006 | Kataoka et al. | |
| 7,172,151 | B2 * | 2/2007 | Biagiotti | B65H 19/2269 242/521 |
| 7,427,424 | B2 * | 9/2008 | Hill | B05C 5/0279 427/207.1 |
| 7,640,959 | B2 * | 1/2010 | Gambini | B05C 1/02 156/356 |
| 8,136,475 | B2 * | 3/2012 | Davis | B05B 13/041 118/301 |
| 2003/0049371 | A1 * | 3/2003 | Fort | B65B 51/023 427/207.1 |

* cited by examiner

DEVICE AND METHOD FOR APPLYING ADHESIVE TO CORES BY A DISPENSING MEANS WHILE THE CORES MOVE ALONG A FEED DIRECTION, THE CORES USED TO PRODUCE A LOG

BACKGROUND OF THE INVENTION

The present invention refers to a device and to a method for applying adhesive to cores which are used to produce a log, also referred to simply as cores for a log.

Rolls of toilet paper or kitchen paper are obtained from so-called logs of paper material obtained by winding, through rewinding machines, a ribbon of paper on a core generally made in the form of a tubular element made of cardboard.

The fixing of the initial edge of the ribbon of paper to the core takes place by applying the adhesive on a portion of the core and placing such a glued portion in contact with the initial edge of the ribbon of paper. Thereafter, the ribbon of paper is wound around the core.

It must be noted that known methods for applying a line of adhesive to a core for a log includes the overflow method. Such a method provides for the presence, along the feeding path of the core, of a slit extending longitudinally, parallel to the central axis of the core, from which the adhesive overflows. The core, rolling over such a slit, collects, but in a manner absolutely lacking in precision, the adhesive necessary for the subsequent fixing of the ribbon of paper. The adhesive that overflows from the slit, however, also tends to excessively soil the machine, as well as the core and the log itself.

In an alternative method, the core is made to pass over a slit that opens onto a container of adhesive. Immersed in the adhesive present in such a container, there is a moveable element, like for example a moveable blade, which cyclically collects an amount of adhesive on its upper edge, and projects from the slit to apply the collected adhesive onto the core that is advancing over the slit. However, this method also has major drawbacks. In particular, the movement of the moveable element must be precisely synchronized with the advancing of the core. During the course of the various application cycles, however, the moveable element that picks up the adhesive tends to get dirty, with the consequence that the ability to pick up the correct amount of adhesive is progressively reduced. Moreover, the cyclical movement of the moveable element inside the adhesive creates waves in the mass of adhesive, which make the picking up of the correct amount of adhesive by the moveable element not very precise and repeatable.

Yet another method foresees the use of batteries of dispensers that extend along the entire length of the core to spray, or deposit, adhesive on a core that advances at such batteries. However, taking into account the substantial length of the cores for a log, and at the same time the small size of the adhesive dispensing nozzles, such batteries must provide for a substantial number of dispensing nozzles, the maintenance of which can be laborious, problematic and expensive.

Moreover, the known methods for applying adhesive on the core, like those described above, have the drawback of not being able to be easily adapted to the different production and processing requirements of the paper, for example to the changing dimensions of the cores, both in terms of length and of diameter, but also to the changing final characteristics both of the log and of the end product obtainable from the log.

BRIEF SUMMARY OF THE INVENTION

The main task of the present invention consists of making a device, and a relative method, for applying adhesive to cores for a log that solves the technical problems outlined above, avoids the drawbacks and overcomes the limitations of the prior art by ensuring an optimal application of the adhesive also with the changing of the characteristics of the core, of the log and of the process for making the end product from the log.

In this task, a purpose of the present invention is to make a device for applying adhesive on cores that has substantial flexibility of use.

Another purpose of the invention consists of making a device for applying adhesive on cores that does not soil the cores, the logs, the end products and the processing machinery.

A further purpose of the invention consists of making a device that is capable of giving the greatest guarantees of reliability and safety in use.

Another purpose of the invention consists of making a device that is easy to make and economically competitive compared to the prior art.

The aforementioned task, as well as the stated purposes and others that will become clearer hereinafter, are accomplished by a device for applying adhesive on cores as outlined in claim 1.

These purposes are also accomplished by making a method for applying adhesive on cores as outlined in claim 15.

Other characteristics are foreseen in the dependent claims.

BRIEF DESCRIPTION OF THE DRAWINGS

Further characteristics and advantages will become clearer from the description of a preferred but not exclusive embodiment of a device for applying adhesive on cores, illustrated by way of non-limiting example with the help of the attached drawings, in which.

DETAILED DESCRIPTION OF THE PREFERRED EMBODIMENTS

Figure 1:
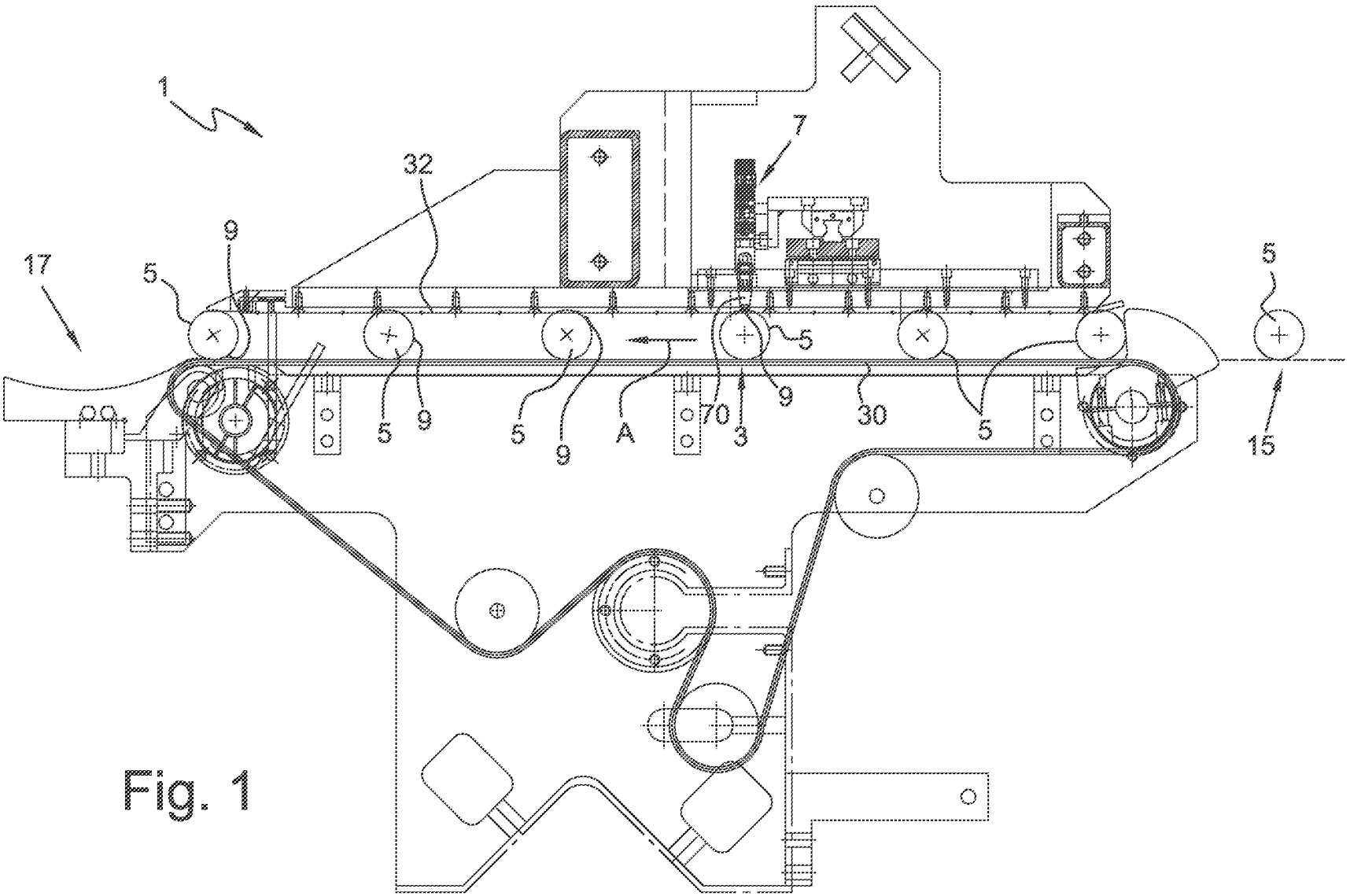
FIG. 1 is a schematic side view of an embodiment of a device for applying adhesive on cores, according to the invention.
Figure 2:
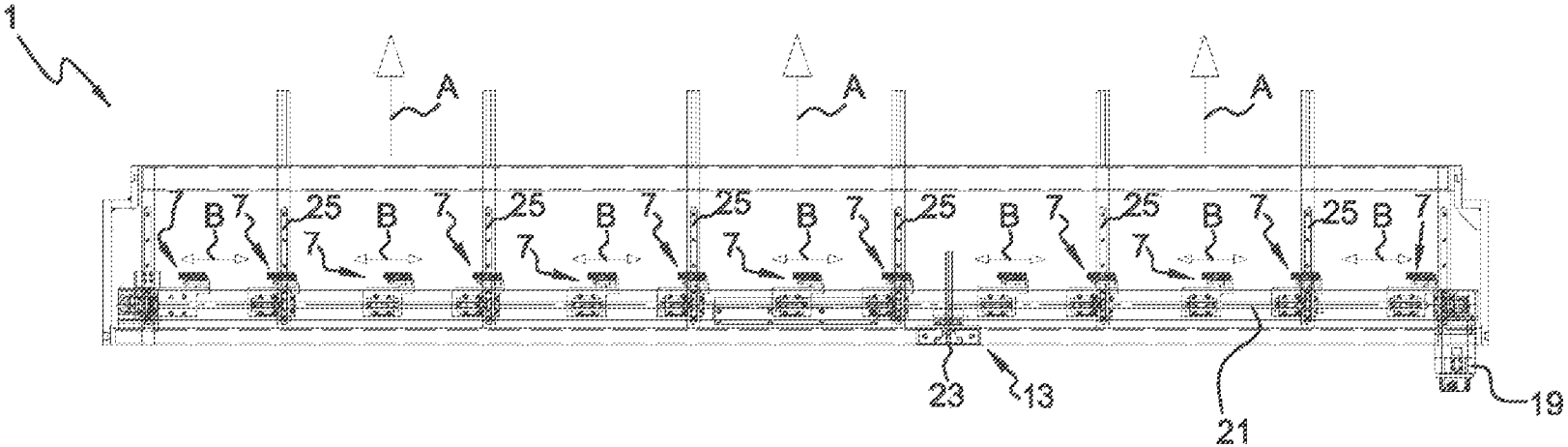
FIG. 2 is a schematic plan view of the device for applying adhesive on cores, according to the invention.

With reference to the quoted figures, the device for applying adhesive on cores, globally indicated with reference numeral 1, comprises moving means 3 configured to cause at least one core 5 to advance along a feed direction A, and at least one dispensing means 7 configured for dispensing an amount of adhesive 9 on such a core 5.

According to the invention, such dispensing means 7 is movable along an application direction B substantially orthogonal to the feed direction A of the cores 5 and is configured to selectively dispense said amount of adhesive 9 along at least one portion 11 of the core 5 during movement along the application direction B.

Advantageously, the portion 11 is rectilinear and continuous.

Basically, such dispensing means 7 dispenses the amount of adhesive 9 while it crosses the portion 11 of the core 5 along the application direction B, in this way applying a strip of adhesive 9 on the core 5.

Advantageously, as also illustrated in the attached figures, the device 1 comprises a plurality of dispensing means 7 moveable along the application direction B.

Such dispensing means 7 can move along the application direction B independently from one another, or all together in a synchronized manner.

Advantageously, every dispensing means 7 is configured to selectively dispense the amount of adhesive 9 along a plurality of portions 11 of the core 5 during movement of the dispensing means 7 along the application direction B, so that such portions 11 are distinct from one another and separate from one another.

Basically, every dispensing means 7 applies, during movement thereof along the application direction B, one or more strips of adhesive 9 along corresponding portions 11 of the core 5. In particular, during travel along the application direction B, the dispensing means 7 can momentarily interrupt, one or more times, the dispensing of adhesive to make a plurality of strips of adhesive 9 separated from one another.

Based on the number of dispensing means 7 present in the device 1, on the maximum length of the stroke of each of them, and on the length of the core 5, every dispensing means 7 can apply one or more strips of adhesive 9 along the longitudinal extension of the core 5.

Figure 3:
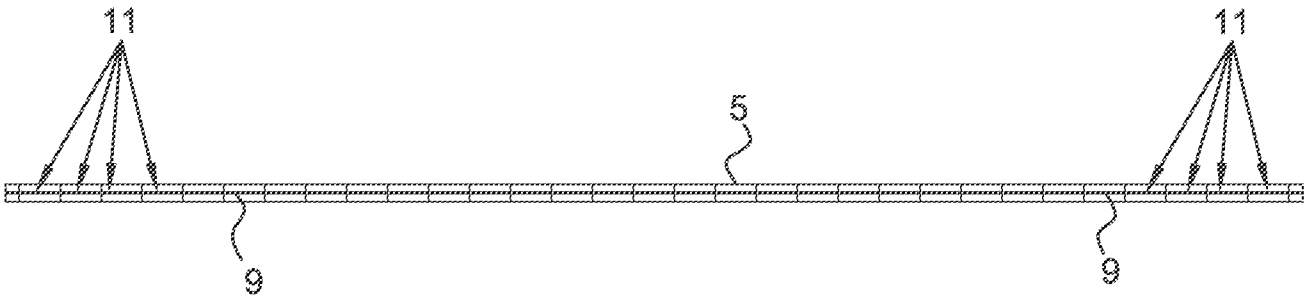
FIG. 3 is a schematic plan view of a core to which adhesive has been applied through the device, according to the invention.
Figure 4:
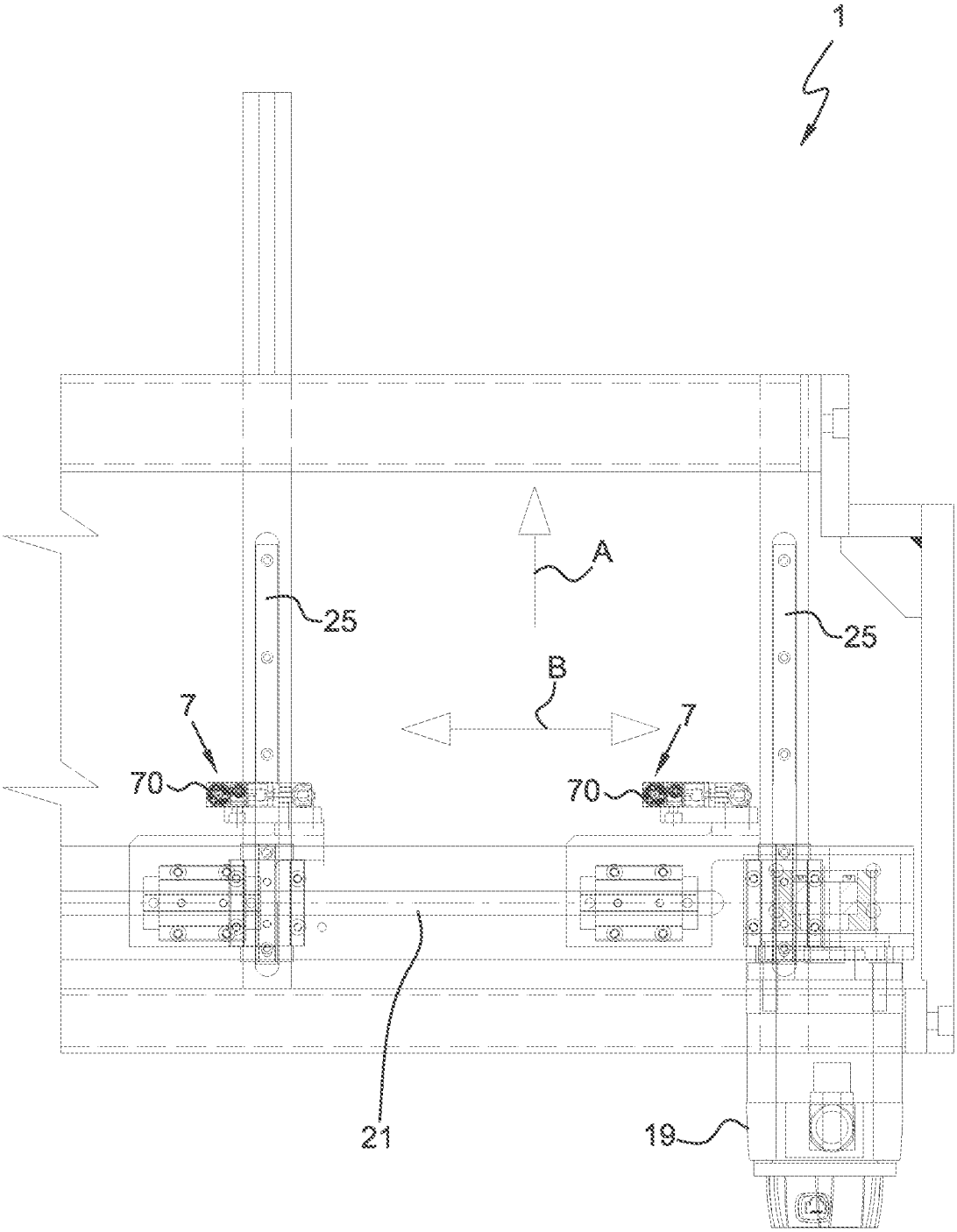
FIG. 4 illustrates an enlarged portion of FIG. 2.

FIG. 3 illustrates, as an example, a core 5 having a succession of strips of adhesive 9 along corresponding portions 11 of the core 5 that engage substantially the entire length of the core 5 itself.

Advantageously, the length of the portions 11 of the core 5 along which the adhesive 9 is applied can be selected to substantially correspond to the axial length of the finished product obtained from the log, like for example a roll of toilet paper or a roll of kitchen paper.

The fact that it is possible to apply strips of adhesive 9 along mutually distinct and separate portions 11 of the core 5 makes it possible to prevent the application of the adhesive 9 in some specific portions of the core 5, for example the portions that will subsequently be subjected to cutting operations of the log to form the end product. In this way, it is possible for example to prevent the blades that will subsequently cut the log to obtain the single rolls of paper from becoming soiled with adhesive.

Advantageously, the moving means 3 are configured to feed the core 5 along a feeding channel, preferably with rectilinear extension, which extends along the feed direction A.

Advantageously, the moving means 3 comprise at least one drive belt 30 adapted for moving the core 5 from a feeding station 15 of the cores 5 to a winding station 17 of a ribbon of paper around the core 5.

Preferably, given the total length of the core 5, there is a plurality of adjacent drive belts 30 parallel to one another.

Advantageously, the moving means 3 comprise, as well as the plurality of mutually parallel drive belts 30, a plurality of ribs 32. In this way, the core 5 is held at the bottom by the drive belts 30 and at the top by the ribs 32, where the drive belts 30 also carry out the feeding of the core 5 in the feed direction A.

Advantageously, the aforementioned feeding channel having rectilinear extension is defined between the drive belts 30 and the ribs 32.

As illustrated in FIG. 1, the moving means 3 of the device 1 can feed a plurality of cores 5 in sequence.

Advantageously, the device 1 comprises adjustment means 13 of the position of the dispensing means 7 along the feed direction A, where such a position of the dispensing means 7 along the feed direction A is adjustable according to the diameter of the core 5, to allow such a core 5 to reach the winding station 17 with its portions 11 having the strips of adhesive 9 angularly oriented so as to suitably face the ribbon of paper that will be wound around the core 5 in such a winding station 17. In particular, as the diameter of the core 5 changes, the extension of the rolling path that the core 5 must travel along the feed direction A before reaching the winding station 17, once the strips of adhesive 9 have been deposited, changes. Therefore, the adjustment of the position of the adhesive dispensing means 7 along the feed direction A makes it possible to ensure that, according to the diameter of the core 5 and therefore the extension of its rolling path, the core 5 always reaches the winding station 17 with a desired angular orientation.

Advantageously, it is also possible to adjust the height of the dispensing means 7 with respect to the feeding plane of the cores 5, according to the diameter of the cores 5 themselves.

Advantageously, the dispensing means 7 comprise a nozzle 70 adapted for dispensing pressurized adhesive, which comes from a closed container.

Advantageously, the feeding of the adhesive to the dispensing means 7 takes place by means of an open feeding circuit, since the adhesive is dispensed in the desired amount, without waste.

Such a circuit substantially comprises a closed adhesive container, and a pump adapted for pushing the adhesive out from the nozzles 70.

In this way, it is not necessary, as on the other hand happens in known adhesive application methods, to recover the substantial excess adhesive that does not reach the core, by means of closed circuits that must necessarily also filter the excess adhesive to put it back into circulation.

Advantageously, the device 1 comprises at least one first actuator 19 adapted for moving said at least one dispensing means 7 along at least one first linear guide 21 that extends along the application direction B.

Advantageously, an actuator can be provided for every dispensing means, in order to be able to move the dispensing means independently from one another.

Preferably, a single first actuator 19 is provided that is adapted for moving, in synchrony, all of the dispensing means 7 present in the device 1. In this case, a single first linear guide 21 is also advantageously provided, along which all of the dispensing means 7 move.

Advantageously, the dispensing means 7 are configured to dispense adhesive during their movement along the application direction B both in the outward stroke and in the return stroke. It is therefore possible to choose whether the dispensing of the adhesive must take place along the outward stroke, return stroke, or along both strokes.

Advantageously, the dispensing means 7 are moveable along at least one second linear guide 25 that extends along the feed direction A, to adjust the position of the dispensing means 7 along the feed direction A.

Advantageously, the device 1 comprises at least one second actuator 23 adapted for moving the dispensing means 7 along at least one second linear guide 25 that extends along the feed direction A, to adjust the position of the dispensing means 7 along such a feed direction A.

As illustrated in the attached figures, preferably there is a single second actuator 23 that moves all of the dispensing means 7 along a plurality of mutually parallel second linear guides 25.

The present invention also concerns a method for applying adhesive to cores for a log comprising the steps of:

causing at least one core 5 to advance along a feed direction A;

delivering an amount of adhesive 9 on such a core 5 by means of at least one adhesive dispensing means 7, or preferably by means of a plurality of dispensing means 7.

According to the invention, the method comprises the steps of:

moving said at least one dispensing means 7 along an application direction B substantially orthogonal to the feed direction A;

selectively delivering said amount of adhesive 9 along at least one portion 11 of the core 5 during movement of the dispensing means 7 along the application direction B.

Advantageously, it is possible to provide for a setting step of the device 1, based on the size of the core 5, which provides for the adjustment of the position of the dispensing means 7 along the feed direction A according to the diameter of the core 5, so as to ensure that the portion 11 of the core 5 along which the adhesive is applied is angularly oriented in a suitable manner to carry out the subsequent processing operations of the paper that take place in the winding station 17.

Moreover, it is also possible to provide for a setting step of the device 1 based on the characteristics of the end product obtainable from the log, which provides for selecting the length and the number of portions 11 of the core 5 along which the adhesive 9 is applied.

The device, and the method, for applying adhesive to cores for a log object of the present invention has the advantage of applying adhesive very precisely and efficiently, avoiding needless waste of adhesive and preventing soiling of the machinery, of the cores and of the logs themselves.

Another advantage of the device, according to the invention, consists of being able to precisely select the portions of the core along which it is wished for the adhesive to be applied, for example to avoid applying the adhesive in the portions of the core that, once the log is completed, will be cut by means of suitable blades, thus avoiding soiling such blades with adhesive, keeping them more efficient and ensuring the precision of the cuts.

The possibility of selecting the portions of the core along which to apply the adhesive makes it possible to very easily adapt the adhesive application method as a function of the characteristics of the log to be made. In this way, the device can be quickly and easily reset to operate on cores intended to produce rolls of toilet roll or rolls of kitchen paper, having different lengths.

Yet another advantage of the device, according to the invention, consists of the fact that it can be set, each time, according to the characteristics of the cores on which to apply the adhesive, without having to intervene manually, for example to replace mechanical components.

Another advantage of the device, according to the invention, consists of the fact that the adhesive is applied precisely and prudently, and therefore it is not necessary to recover and filter the excess adhesive. Moreover, given that the adhesive container is closed, the adhesive can be kept in optimal conditions, preventing the degradation of its properties, as occurs on the other hand in the case of the methods of the prior art where the adhesive tanks or containers are open.

The device, and the method, for applying adhesive to cores for a log thus conceived can undergo numerous modifications and variants, all falling within the scope of the invention; moreover, all of the details can be replaced by technically equivalent elements. In practice, the materials used, as well as the sizes, can be whatever according to the technical requirements.

The invention claimed is:

1. A device (1) for applying an adhesive to cores comprising:

a moving means (3) configured to cause at least one core (5) to advance along a feed direction (A), the feed direction being a linear direction along a radial axis of the at least one core (5);

at least one dispensing means (7) configured for dispensing an amount of the adhesive (9) on said core (5); and an adjustment means (13) for adjusting of a position of said dispensing means (7) along said feed direction (A), the position of said dispensing means (7) along said feed direction (A) being adjustable according to the diameter of said core (5), wherein said dispensing means (7) is movable along one first linear guide (21) in an application direction (B), wherein said application direction (B) is substantially orthogonal to said feed direction (A) and parallel to an axial length of the at least one core, said one first linear guide (21) extends in the application direction (B), and said dispensing means (7) is configured to selectively dispense said amount of the adhesive (9) along at least one portion (11) of said core (5) during movement along said one first linear guide (21) in said application (B); and said adjustment means (13) includes a second actuator (23) adapted to move said at least one dispensing means (7) along a second linear guide (25) extending along said feed direction (A); wherein a single first actuator (19) is adapted for moving all of a plurality of dispensing means (7) in synchrony along the one first linear guide (21) in the application direction (B).

2. The device (1) according to claim 1, wherein said dispensing means (7) is configured to selectively dispense said amount of the adhesive (9) along a plurality of portions (11) of said core (5) during said movement along said application direction (B), said portions (11) being distinct and mutually separate.

3. The device (1) according to claim 1, wherein said moving means (3) are configured to feed said core (5) along a feeding channel that extends along said feed direction (A).

4. The device (1) according to claim 3, wherein said feeding channel has a rectilinear extension.

5. The device (1) according to claim 1, wherein said moving means (3) comprise at least one drive belt (30) adapted to move said at least one core (5) from a feeding station (15) of cores (5) to a winding station (17) of at least one ribbon of paper around said core (5).

6. The device (1) according to claim 5, further comprising a plurality of ribs (32), said at least one core (5) being held at the bottom by said drive belts (30) and at the top by said ribs (32), said drive belts (30) also carrying out the feeding of said core (5) in said feed direction (A).

7. The device (1) according to claim 6, wherein said feeding channel is defined between said drive belts (30) and said ribs (32).

8. The device (1) according to claim 1, wherein the length of each of said at least one portion (11) of said core (5) along which said amount of the adhesive (9) is applied is selectable so as to correspond essentially with the axial length of a finished product obtained from the core.

9. The device (1) according to claim 1, wherein said dispensing means (7) comprises a nozzle (70) adapted to deliver a pressurized adhesive from a closed container.

10. A method for applying an adhesive to cores comprising the steps of:

causing at least one core (5) to advance along a feed direction (A), the feed direction being a linear direction along a radial axis of the at least one core:

delivering an amount of the adhesive (9) to said core (5) by means of at least one adhesive dispensing means (7);

moving said at least one dispensing means (7) along an application direction (B), said application direction (B) is substantially orthogonal to said feed direction (A) and parallel to an axial length of the at least one core;

adjusting, according to a diameter of said core (5), a position of said dispensing means (7) along said feed direction (A) with an adjustment means (13);

selectively delivering said amount of the adhesive (9) along at least one portion (11) of said core (5) during movement of said dispensing means (7) along said application direction (B), wherein the adjustment means includes at least one second actuator (23) adapted to move said at least one dispensing means (7) along an at least one second linear guide (25) in said feed direction (A), said second linear guide (25) extending along said feed direction (A), such that said position of said dispensing means (7) is adjustable along said feed direction (A); and moving with a single first actuator (19) allo f a plurality of dispensing means (7) in synchrony along one first linear guide (21) in the application direction (B), wherein said first linear guide (21) extends in the application direction (B).

* * * * *